US011649620B2

(12) United States Patent
Bammerlin et al.

(10) Patent No.: US 11,649,620 B2
(45) Date of Patent: May 16, 2023

(54) SANITARY OUTLET FITTING

(71) Applicant: Neoperl GmbH, Mullheim (DE)

(72) Inventors: Werner Bammerlin, Mullheim (DE); Holger Schurle, Mullheim (DE)

(73) Assignee: Neoperl GmbH, Müllheim (DE)

( * ) Notice: Subject to any disclaimer, the term of this patent is extended or adjusted under 35 U.S.C. 154(b) by 338 days.

(21) Appl. No.: 14/519,618

(22) Filed: Oct. 21, 2014

(65) Prior Publication Data

US 2015/0115063 A1 Apr. 30, 2015

(30) Foreign Application Priority Data

Oct. 25, 2013 (DE) ..... 202013009472.9

(51) Int. Cl.
*E03C 1/086* (2006.01)
*E03C 1/04* (2006.01)

(52) U.S. Cl.
CPC ..... *E03C 1/086* (2013.01); *E03C 1/0404* (2013.01)

(58) Field of Classification Search
CPC . E03C 1/086; E03C 1/08; E03C 1/084; E03C 1/0404; E03C 1/021; E03C 1/0401; B05B 15/65; B05B 1/185; B05B 1/22
USPC ..... 239/600, 428.5
See application file for complete search history.

(56) References Cited

U.S. PATENT DOCUMENTS 3,224,793 A * 12/1965 Benjamin ..... E03C 1/084 285/8
5,551,637 A * 9/1996 Lo ..... B05B 1/1654 239/394
6,290,147 B1 * 9/2001 Bertrand ..... B05B 1/1618 239/444
7,490,372 B2 * 2/2009 Huang ..... B05B 15/065 285/383
7,766,043 B2 * 8/2010 Thomas ..... E03C 1/04 137/801
8,104,512 B2 * 1/2012 Nelson ..... E03C 1/0404 137/801
8,185,984 B2 * 5/2012 Meehan ..... E03C 1/0401 4/695
8,695,625 B2 * 4/2014 Marty ..... E03C 1/0401 137/315.12
8,727,239 B2 5/2014 Weis et al.
8,870,095 B2 * 10/2014 Hughett ..... E03C 1/084 239/428.5
2002/0079471 A1 * 6/2002 Shen ..... E03C 1/08 251/118

(Continued)

FOREIGN PATENT DOCUMENTS

WO 2004038112 5/2004
WO 2008094250 8/2008
WO 2009146410 12/2009

*Primary Examiner* — Christopher R Dandridge
(74) *Attorney, Agent, or Firm* — Volpe Koenig

(57) ABSTRACT

A sanitary outlet fitting (1) having a fitting body (3), the body interior of which opens into a water outlet (5), with an intermediate holder (2) which (2) is fastenable in the water outlet (5), and with a sanitary insert (6) which is insertable into the end side of the intermediate holder (2), the end side being of open design and being on the outflow side, and is fixable therein. The outlet fitting has, on the inflow side, the intermediate holder (2) connected or connectable to a water hose guided in the tube interior (4) of the fitting body (3).

15 Claims, 5 Drawing Sheets

(56) References Cited

U.S. PATENT DOCUMENTS

| | | | | |
|---|---|---|---|---|
| 2003/0102037 | A1* | 6/2003 | Parsons | E03C 1/05<br>137/624.11 |
| 2004/0154673 | A1* | 8/2004 | Mascari | E03C 1/0401<br>137/801 |
| 2006/0130907 | A1* | 6/2006 | Marty | E03C 1/057<br>137/613 |
| 2006/0186030 | A1* | 8/2006 | Sohn | B01D 35/30<br>210/232 |
| 2010/0071778 | A1* | 3/2010 | Nelson | E03C 1/084<br>137/15.01 |
| 2011/0036930 | A1* | 2/2011 | Denzler | E03C 1/084<br>239/428.5 |
| 2011/0089263 | A1* | 4/2011 | Hughett | E03C 1/0404<br>239/428.5 |

* cited by examiner

SANITARY OUTLET FITTING

INCORPORATION BY REFERENCE

The following documents are incorporated herein by reference as if fully set forth: German Patent Application No.: 202013009472.9, filed Oct. 25, 2013.

BACKGROUND

The invention relates to a sanitary outlet fitting having a fitting body, the body interior of which opens into a water outlet, with an intermediate holder which is fastenable in the water outlet, and with a sanitary insert which is insertable into the end side of the intermediate holder, said end side being of open design and being on the outflow side, and is fixable therein.

Sanitary outlet units, such as, for example, jet regulators, are customarily fastened releasably in the outlet of a cast sanitary fitting, for example by screw, clamping or latching connections. This requires a correspondingly machined cast fitting which can be provided, for example, with a matching thread or with fastening devices corresponding in another way. Up to now, during the production of cast sanitary fittings, machining steps, such as, for example, cutting a thread or an encircling groove therein, therefore occur, or other fastening devices are required for the insertion of the sanitary outlet unit. Additional machining steps constitute a high outlay on work and costs. Furthermore, during the process of producing cast fittings, shrink holes or similar casting errors may also occur, which lead to problems in the subsequent further machining or surface treatment of the cast fittings. Under some circumstances, such error-affected outlet fittings may no longer continue to be used. If the water jet is intended to be guided via a hygienic water channel through the cast fitting, without direct contact therewith, via a separate conduit provided within the cast fitting, it is likewise required to use correspondingly machined cast fittings.

WO 2004/038112 A1 has already disclosed a sanitary outlet fitting of the type mentioned at the beginning, with this outlet fitting having a tubular fitting body, the tube interior of which opens into a water outlet. The previously known outlet fitting has a cup- or sleeve-shaped intermediate holder which is held in the water outlet of the fitting body by pressing, adhesive bonding, snapping, interlocking or wedging. The previously known outlet fitting is assigned a sanitary insert which is insertable into the end side of the intermediate holder, said end side being of open design and being on the outflow side, and is fixable releasably therein. The insert can be designed as a jet regulator, a flow regulator, a backflow preventer and/or a sieve attachment. In order to be able to seal the intermediate holder in the water outlet and in order to prevent undesirable leakage flows between the intermediate holder and the fitting body, it is proposed, in WO 2004/038112 A1, that an O-sealing ring, a flat seal or other additional seals, or seals injection molded onto the intermediate holder are provided, or that sealing takes place by means of the connecting means, such as, for example, the adhesive used in the adhesive bonding.

Since the fitting body is regularly designed as a metal cast part, since such cast parts generally have shrink holes, in the region of which the fitting can be sealed less readily, there is the risk that undesirable leakage flows form over time between the intermediate holder and the fitting body. If, however, the sealing takes place by elastic sealing rings or by the layer of adhesive, the materials used have to be food compatible, which may additionally further increase the costs for production.

SUMMARY

It is therefore in particular the object to provide an outlet fitting of the type mentioned at the beginning, which is distinguished by a reduced production cost.

The outlet fitting according to the invention has a fitting body, the body interior of which opens into a water outlet. The outlet fitting according to the invention has an intermediate holder which is fastenable in the water outlet. A sanitary insert which can be designed as a jet regulator, flow regulator or, for example, as a sieve attachment, or can have such jet-guiding or jet-forming components, is inserted into the end side of the intermediate holder, said end side being of open design and being on the outflow side. According to the invention, it is provided that, on the inflow side, the intermediate holder has a connecting branch which is connected or connectable to a water hose guided in the tube interior of the fitting body. The water flowing through the water hose can flow via the connecting branch into the intermediate holder and, after flowing through the insert located therein, can emerge as a homogeneous, sparkling and soft, non-sputtering and optionally also flow-limited water jet. Since the water no longer flows directly through the body interior of the fitting body, but, instead, flows through the water hose guided in the latter, machining which is required in order to avoid undesirable leakage flows or else leakages, in particular of the outlet fitting itself, is no longer absolutely necessary. Since seals and sealing layers of adhesive in the annular zone between the intermediate holder, on the one hand, and the fitting body, on the other hand, are unnecessary, the production costs for the outlet fitting according to the invention is considerably reduced.

The intermediate holder provided in the outlet fitting according to the invention is combinable with jet regulators or other sanitary outlet units which can be inserted and fixed even in unmachined sanitary outlet fittings. Work- and cost-intensive machining steps during the production and further processing in particular of cast fittings are therefore dispensed with. On the inflow side, the intermediate holder is connected or connectable to a water hose guided in the body interior of the fitting body. This water hose constitutes a particularly hygienic water channel which avoids any direct contact of the water with the sanitary outlet fitting.

In order also to be able to carry out repairs or maintenance in the body interior of the fitting body of a sanitary outlet fitting when required, it is expedient if the intermediate holder is fastenable releasably in the water outlet. After the intermediate holder in the water outlet has been released, repair work and maintenance work are also possible in the body interior of the fitting body without the intermediate holder, which has been removed at least temporarily from the outlet fitting, getting in the way.

In a particularly advantageous embodiment according to the invention, the outlet fitting is produced without machining at least in that region of the water outlet thereof which receives the intermediate holder. The outlet fitting here can also be produced, for example, from sheet metal.

In order, when required, to be able to remove the insert, which is held in the end side of the intermediate holder, said end side being on the outflow side, and to be able to expose said insert, for example for decalcification purposes or for other maintenance work, it is advantageous if the sanitary insert is fixable releasably in the end side of the intermediate holder, said end side being on the outflow side.

In order to be able to connect the intermediate holder to the insert in the body interior of the outlet fitting securely, tightly and fixedly, it is advantageous if, on the inflow side, the intermediate holder has a connecting branch which is connected or connectable to the water hose.

In order to be able to fasten the intermediate holder sufficiently firmly in the water outlet of the fitting body, it is advantageous if the intermediate holder has at least one fastening means which is connectable in a form-fitting and/or frictional manner to the fitting body. Since the intermediate holder has at least one fastening means which permits a form-fitting and/or frictional connection on the fitting body, the outlay associated with the production and installation of the outlet fitting according to the invention is also additionally reduced.

In an embodiment according to the invention that can be produced in a particularly simple manner and can be fitted with little outlay, the sanitary insert is designed as an insertable cartridge which has a cartridge housing, and the cartridge housing is fastenable releasably in the intermediate holder by means of a screw connection or bayonet connection. In this embodiment, the sanitary insert can be inserted into the intermediate holder in order subsequently to be fixed releasably there by means of a screw or bayonet-type connection.

In a preferred embodiment here, which can be produced with particularly little outlay, an external thread is provided on the housing circumference of the cartridge housing, which external thread interacts with an internal thread in the intermediate holder.

The insert through which the water flows can serve to guide, to shape or else to limit the water jet. An advantageous embodiment according to the invention therefore consists in that the insert has a jet regulator and/or a flow regulator and preferably a sieve attachment on the inflow side. The sieve attachment can be used here to filter out the dirt particles which have possibly been entrained in the water before the water flows out of the water outlet of the sanitary outlet fitting.

In order to be able to fasten the intermediate holder in such a fixed and at the same time readily releasable manner in the water outlet of the fitting body, in a development according to the invention, at least one web or at least one wall protrudes on that end side of the intermediate holder which is on the inflow side, which web or which wall acts in a form-fitting or frictional manner on at least one mating wall or at least one mating web in the fitting body.

So that the intermediate holder can also withstand high water pressures and therefore the intermediate holder also resists torsional forces in the direction of rotation that act when the sanitary insert is unscrewed from and screwed into the intermediate holder, it is advantageous if at least two webs or walls, which are assigned to one another and are spaced apart from one another, or mating webs or mating walls are provided on the intermediate holder or in the fitting body and delimit an intermediate space or insertion space, in which intermediate space or insertion space a mating web or a mating wall or a web or a wall of the other component in each case is fixable in a form-fitting or frictional manner.

It can be expedient if at least one retaining projection protrudes on at least one web or one wall or mating web or mating wall, said retaining projection being determined for bearing against the adjacent mating web or adjacent mating wall or web or wall. Such a retaining projection can be designed virtually in the manner of a barb and can bring about the secure support between the intermediate holder, on the one hand, and that edge region of the fitting body which bounds the water outlet, on the other hand.

In a preferred embodiment here according to the invention, retaining projections protruding in each case into the intermediate space or insertion space are provided on the webs or walls, which are assigned in pairs to one another, or mating webs or mating walls.

In addition to the webs or walls ensuring the connection between intermediate holder and fitting body, or instead of same, the intermediate holder can be expanded at least in a partial region, by insertion of the sanitary insert, in such a manner that the intermediate holder is subsequently held in a form-fitting or frictional manner in the water outlet.

In a preferred embodiment here, which is distinguished by reliable functioning, the intermediate holder circumference of the intermediate holder has at least one spring web which, by insertion of the sanitary insert, is movable or reboundable from a release position into a retaining position, in which retaining position the spring web engages behind a partial region of the fitting body.

So that the at least one spring web provided on the intermediate holder can readily spring into the release position and can just as easily rebound into the retaining position, it is advantageous if the free spring-web end of the at least one spring web is oriented in the insertion direction of the intermediate holder.

A particularly firm support of the intermediate holder on that edge region of the fitting body which bounds the water outlet is assisted if a retaining cam or a retaining projection, with which the spring web engages behind the inner circumferential edge region of the fitting body, which inner circumferential edge region bounds the water outlet, protrudes at the free spring-web end of the at least one spring web.

BRIEF DESCRIPTION OF THE DRAWINGS

Developments according to the invention emerge from the drawing in conjunction with the description and the claims. The invention is described in more detail below with reference to preferred exemplary embodiments.

In the drawings.

DETAILED DESCRIPTION OF THE PREFERRED EMBODIMENTS

Figure 1:
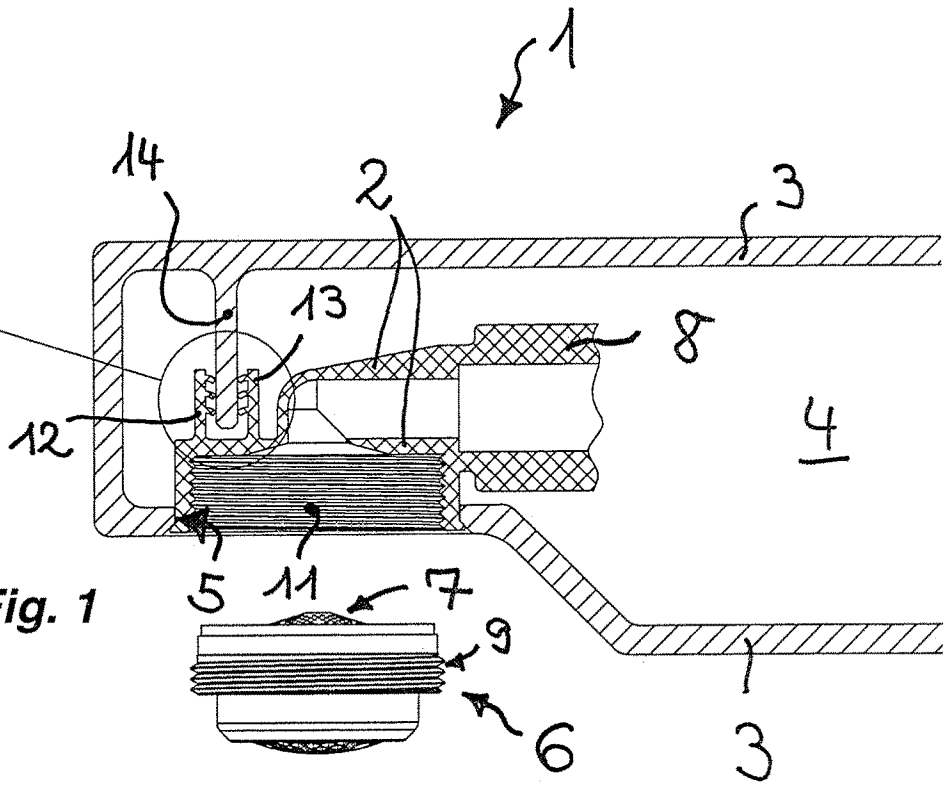
FIG. 1 shows a sanitary outlet fitting, which is illustrated in a longitudinal section, in the region of the water outlet thereof, wherein an intermediate holder having a connecting branch for a water hose and into which a sanitary insert can be inserted is held in the water outlet of the sanitary outlet fitting.
Figure 2:
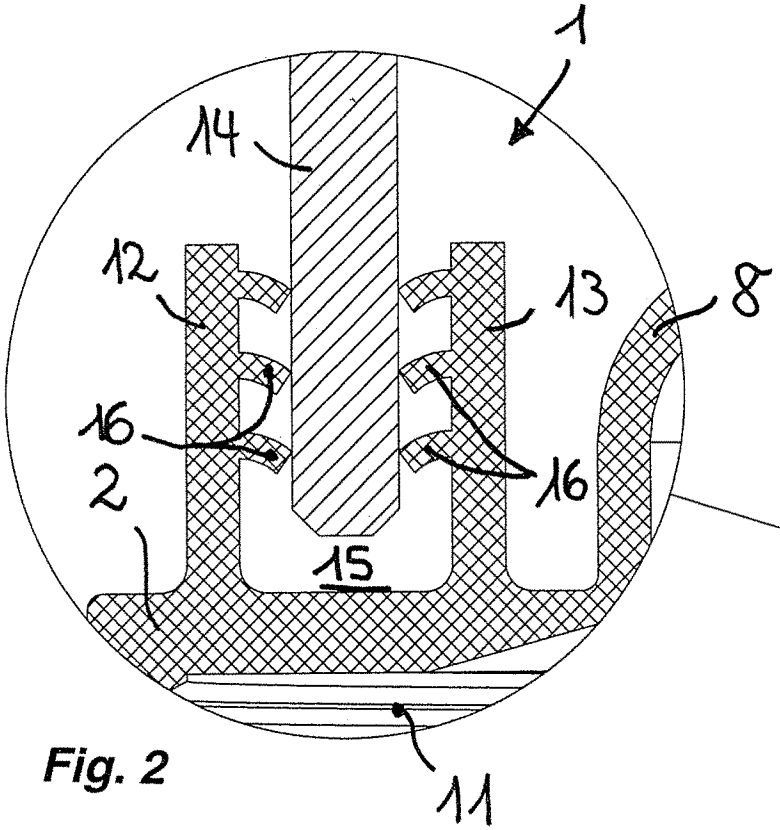
FIG. 2 shows the intermediate holder, which is illustrated in the longitudinal section of a detail and is inserted into the fitting body of the outlet fitting, in the region of a frictional connection between intermediate holder and fitting body.
Figure 3:
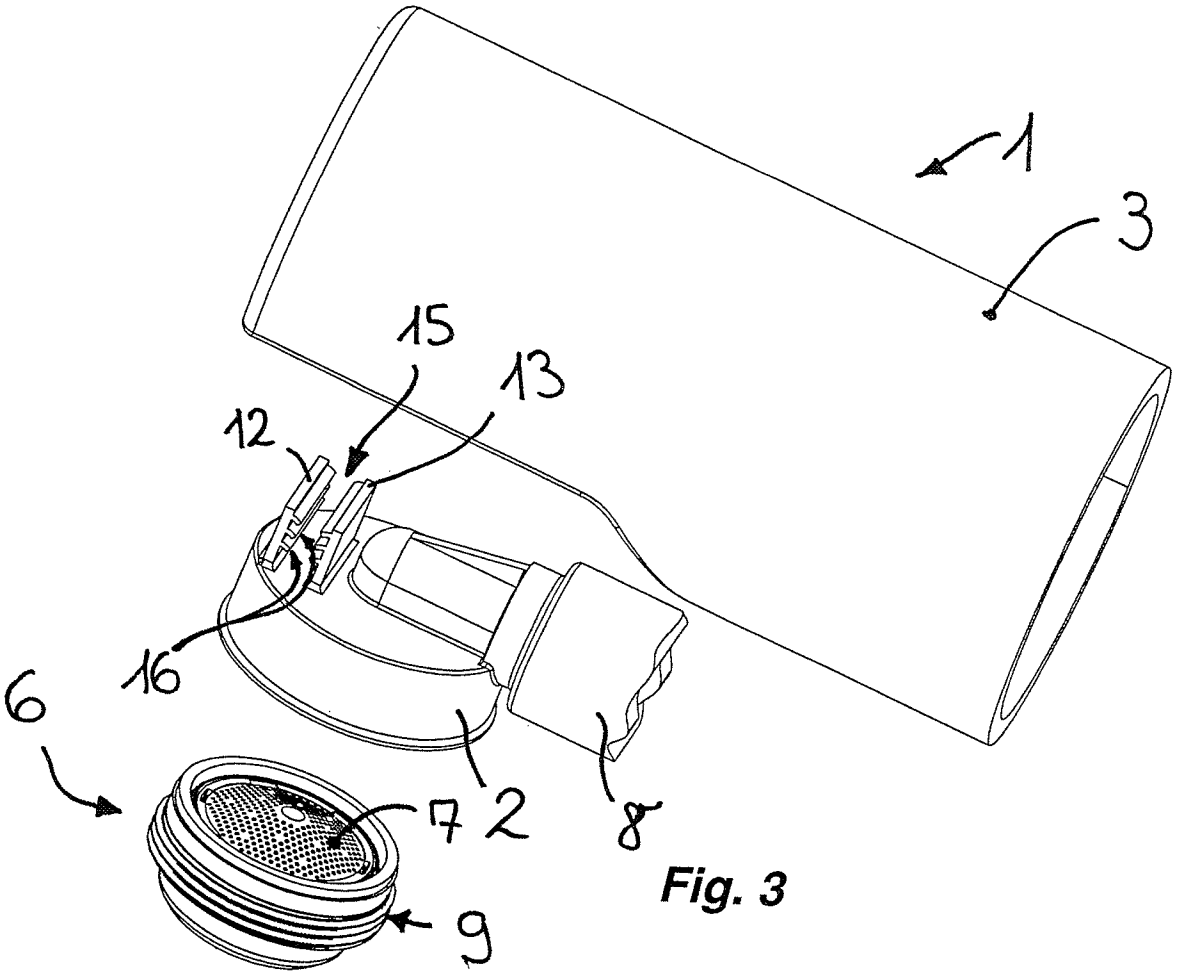
FIG. 3 shows the sanitary outlet fitting from FIGS. 1 and 2 in an exploded illustration of the individual parts, in a top view of the components thereof.
Figure 4:
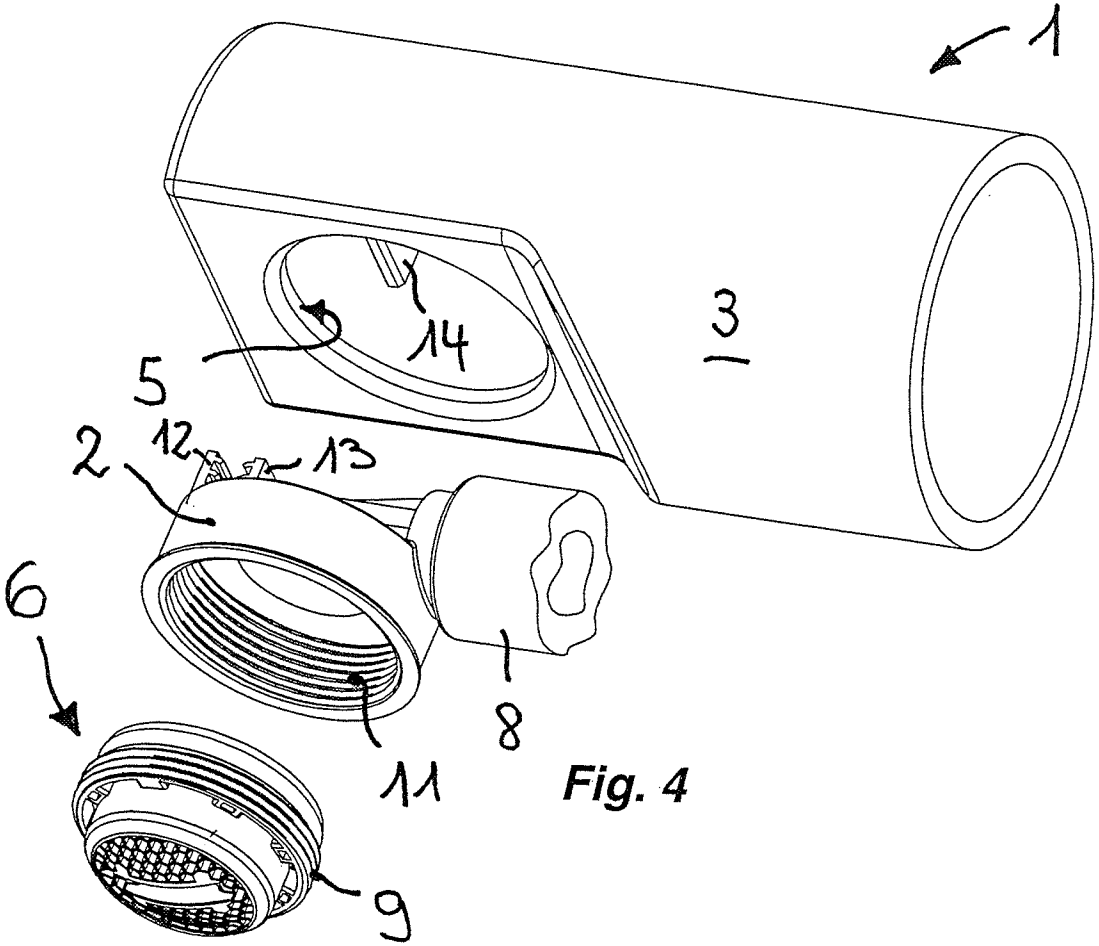
FIG. 4 shows the outlet fitting from FIGS. 1 to 3 in an exploded illustration of the individual parts, in a bottom view of the essential components thereof.
Figure 5:
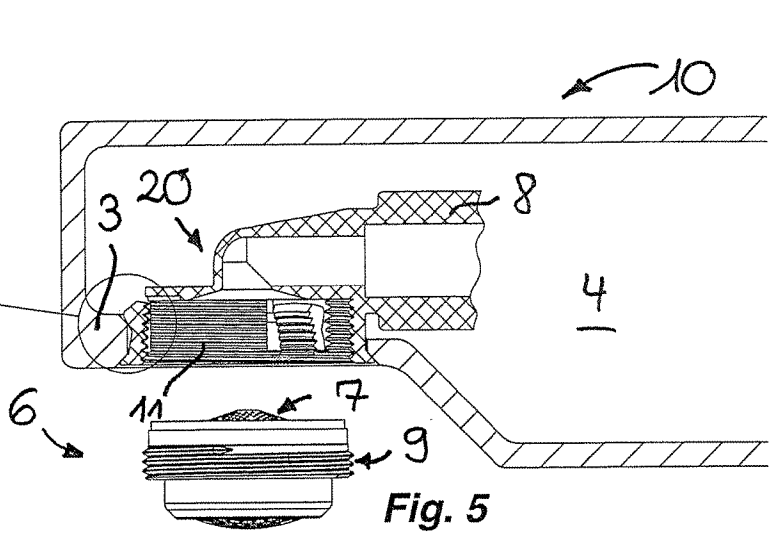
FIG. 5 shows a sanitary outlet fitting, which is illustrated in a partial longitudinal section, in the region of the water outlet thereof, wherein an intermediate holder is held in the water outlet also of the outlet fitting illustrated here, said intermediate holder being expandable at least in a partial region, by insertion of a sanitary insert, in such a manner that the intermediate holder is subsequently held in a form-fitting or frictional manner in the water outlet, wherein the insert is shown here directly before the insertion into the intermediate holder.
Figure 6:
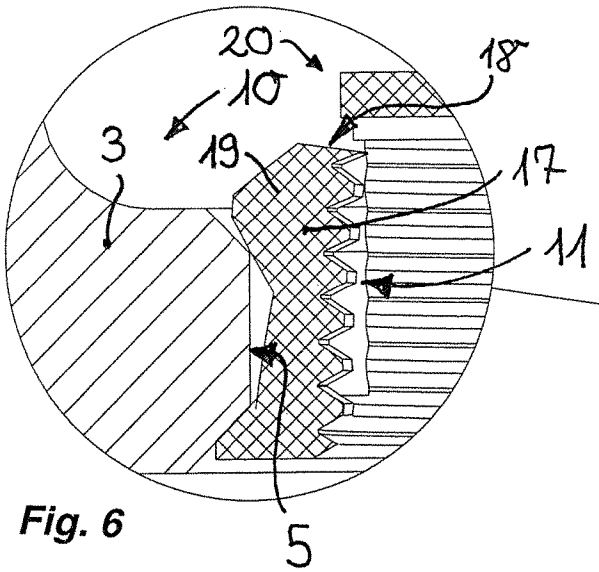
FIG. 6 shows the intermediate holder which has already been inserted into the water outlet of the fitting body and is illustrated here directly before the insertion of the sanitary insert.
Figure 7:
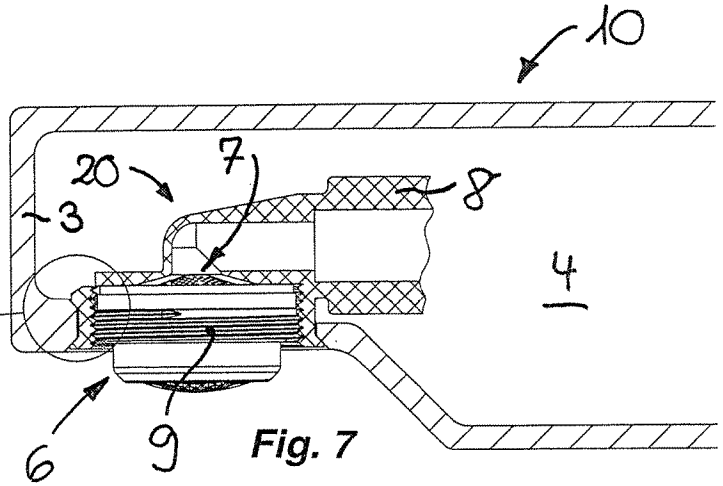
FIG. 7 shows the outlet fitting from FIGS. 5 and 6 after the insertion of the sanitary insert into the intermediate holder located in the water outlet.
Figure 8:
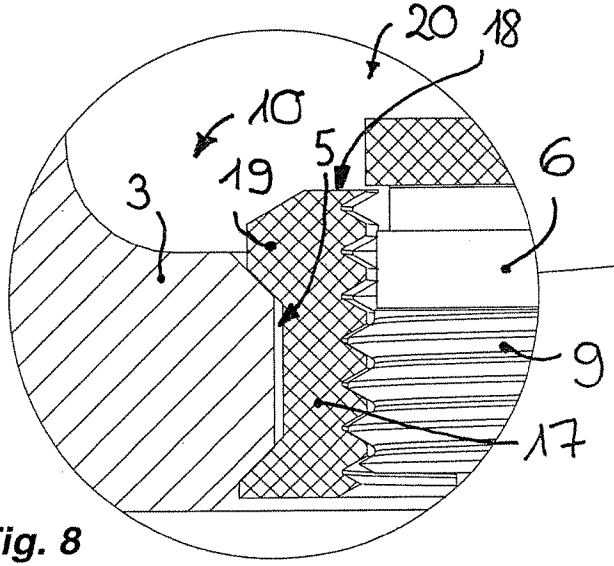
FIG. 8 shows the outlet fitting from FIGS. 5 to 7 in the longitudinal section of a detail in the region of the intermediate holder thereof, wherein, after the insertion of the insert, the intermediate holder here then engages behind the inner circumferential edge region of the fitting body, which inner circumferential edge region bounds the water outlet.
Figure 9:
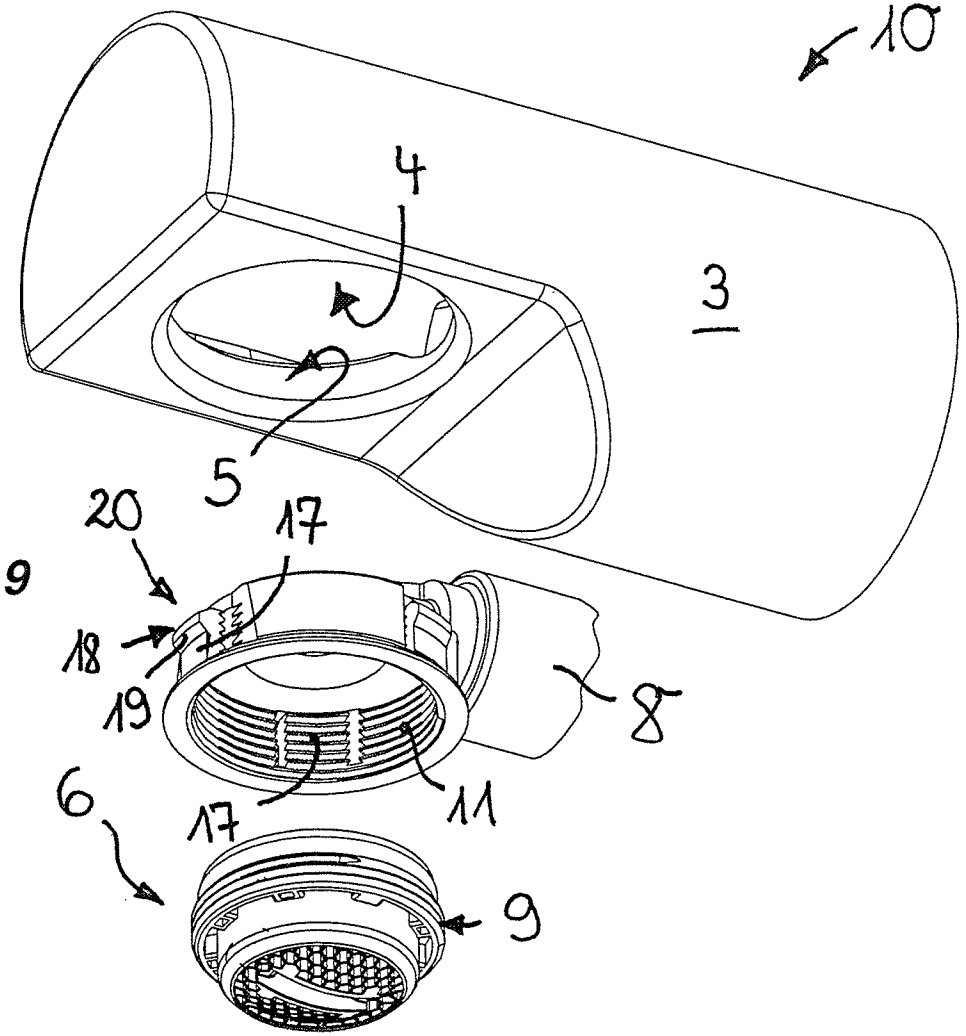
FIG. 9 shows the outlet fitting from FIGS. 5 to 8, which is shown in an exploded illustration of the individual parts, in a bottom view of the components thereof.

FIGS. 1 to 9 illustrate a sanitary outlet fitting in two different embodiments 1, 10. The outlet fittings 1, 10 have a tubular fitting body 3, the tube interior 4 of which opens into a water outlet 5. An intermediate holder 2, 20 which here is of cup-shaped design is fastenable in the water outlet 5 of the outlet fittings 1, 10. A sanitary insert 6 which can have a jet regulator and, in addition or instead, a flow regulator and preferably also a sieve attachment 7 on the inflow side is insertable into the end side of the intermediate holders 2, 20, said end side being of open design and being on the outflow side.

It can be seen in FIGS. 1 to 9 that, on the inflow side, the intermediate holder 2, 20 has a connecting branch 8 which is connected or connectable to a water hose which is guided in the tube interior 4 of the fitting body 3, but is not illustrated specifically here. The tap water flowing through the water hose can flow into the intermediate holder 2, 20 via the connecting branch 8 and, after flowing through the insert 6 located therein, can flow out as a homogeneous, non-sputtering, optionally sparkling and soft and, if required, flow-limited water jet. Since the water no longer flows directly through the tube interior 4, but instead flows through the water hose guided therein, there need be no concern about undesirable leakage flows and/or leakages at the outlet fitting 1, 10 itself if the fitting body 3, which is produced, for example, as a metal cast part, should have shrink holes in the region of the water outlet 5. Since sealing rings and sealing layers of adhesive in the annular zone between the intermediate holder 2, 20 and the fitting body 3 are unnecessary, the outlay on production of the outlet fittings 1, 10 illustrated here is considerably reduced. Since the water outlet 5 of the fitting body is sealed by the intermediate holder 2, 20 in the outer annular zone thereof and since the intermediate holder 2, 20 is fixed in a form-fitting and/or frictional manner in the water outlet 5, the outlet fittings can optionally also be produced from sheet metal.

It is clear from FIGS. 1, 3 to 5 and 7 and 9 that the sanitary insert 6 is designed as an insertable cartridge which has a cartridge housing. The cartridge housing of the insertable cartridge 6 is fastened here in the intermediate holder 2, 20 by means of a screw connection. For this purpose, the insert part 6 has an external thread 9 on the housing circumference of its cartridge housing, which external thread 9 interacts with an internal thread 11 in the intermediate holder 2, 20.

The intermediate holders 2, 20 assigned to the outlet fittings 1, 10 have at least one fastening means which is connected or connectable in a form-fitting manner and, in addition or instead, also in a frictional manner to the fitting body 3.

In the case of the outlet fitting 1 shown in FIGS. 1 to 4, at least one web or one wall 12, 13 protrudes on that end side of the intermediate holder 2 which is on the inflow side, which web or which wall 12, 13 acts in a form-fitting manner and, in addition or instead, in a frictional manner on at least one mating wall 14 or a mating web in the tube interior 4 of the fitting body 3. In the case of the fitting embodiment 1 which is shown by way of example in FIGS. 1 to 4, webs or walls 12, 13, which are assigned in pairs to one another and which delimit an intermediate space or insertion space 15 therebetween, are provided on that end side of the intermediate holder 2 which is on the inflow side. The assigned mating web protruding in the tube interior of the fitting body 3 in the direction of the water outlet 5, or the protruding mating wall 14 is insertable and fixable in a form-fitting and/or frictional manner in said intermediate space or insertion space 15. At least one barb-like retaining projection 16 can protrude at least on the at least one web or on the at least one wall 12, 13 of the intermediate holder 2, 20 or at least on the at least one mating web or the at least one mating wall 14 in the fitting body, said retaining projection being designed here, for example, as an elastically flexible retaining web. It can readily be seen in the longitudinal section of the detail in FIG. 2 that at least two, and preferably more than two, retaining projections 16 which are spaced apart from one another in the insertion direction are provided, said retaining projections being placed in a frictional manner against the mating wall 14 after being pushed onto same.

It can be seen in FIGS. 5 to 9 that the outlet fitting 10 illustrated there has an intermediate holder 20 which can be expanded at least in a partial region, by insertion of the sanitary insert 6, in such a manner that the intermediate holder 20 is subsequently held in a form-fitting manner and, in addition or instead, also in a frictional manner in the water outlet 5 of the fitting body 3. The free spring-web end 18 of the at least one spring web 17 is oriented in the insertion direction of the intermediate holder 20. A retaining cam 19 or a retaining projection, with which the retaining cam 19 of the spring web 17 engages behind the inner circumferential edge region of the fitting body 3, which inner circumferential edge region bounds the water outlet 5, protrudes at the free spring-web end 18 of the at least one spring web 17. By insertion of the insert 6 into the intermediate holder 20, a firm connection between the intermediate holder 20 and the fitting body 3 is therefore achieved, which connection brings about a support of the intermediate holder 20 in the outlet fitting 10, the support being self-reinforcing under the pressure of the inflowing water.

LIST OF REFERENCE NUMBERS

1 outlet fitting (according to FIGS. 1 to 4)
2 intermediate holder (according to FIGS. 1 to 4)
3 fitting body
4 tube interior
5 water outlet
6 insert
7 sieve attachment
8 connecting branch
9 external thread
10 outlet fitting (according to FIGS. 5 to 9)
11 internal thread

12 wall
13 wall
14 mating wall
15 intermediate space or insertion space
16 retaining projection
17 spring web
18 spring-web end
19 retaining cam
20 intermediate holder (according to FIGS. 5 to 9)

The invention claimed is:

1. A sanitary outlet fitting (1, 10) comprising a fitting body (3) having an enclosed body interior (4) which opens into a water outlet (5) having an outflow end, an intermediate holder (2, 20) having an inflow side and an outflow side, the intermediate holder being inserted from the outflow end in a direction generally normal to a longitudinal extension of the fitting body into the water outlet (5) in the fitting body such that the intermediate holder (2, 20) is encapsulated within the water outlet (5) of the fitting body (3), and a sanitary insert inserted from the outflow end into an end side of the intermediate holder (2, 20), said end side being open and being on the outflow side of the intermediate holder, the inflow side of intermediate holder (2, 20) has a connecting branch (8) which is connectable to a water hose, two webs or walls (12, 13) protrude on an end side of the intermediate holder (2) which is on the inflow side, said webs or said walls (12, 13) define a space therebetween that acts in a form-fitting or frictional manner on a single mating wall (14) or a single mating web integrally formed with and extending from the enclosed body interior of the fitting body (3), and the two webs or walls (12, 13) delimit an insertion space (15), and the single mating web or the single mating wall (14) is fixable via the space between said webs or walls acting in a form-fitting or frictional manner by insertion in the direction generally normal to a longitudinal extension of the fitting body into said insertion space (15) to connect the intermediate holder (20) to the fitting body (3).

2. The outlet fitting as claimed in claim 1, wherein the connecting branch (8) is connectable to the water hose that is guided in the body interior (4) of the fitting body (3).

3. The outlet fitting as claimed in claim 1, wherein the outlet fitting (1, 10) is produced without machining at least in a region of the water outlet thereof which receives the intermediate holder (2, 20).

4. The outlet fitting as claimed in claim 1, wherein the intermediate holder (2, 20) has at least one fastener which is connectable in at least one of a form-fitting or frictional manner to the fitting body (3).

5. The outlet fitting as claimed in claim 1, wherein the sanitary insert (6) is an insertable cartridge which has a cartridge housing, and the cartridge housing is fastenable releasably in the intermediate holder (2, 20) by a screw connection or bayonet connection.

6. The outlet fitting as claimed in claim 5, wherein an external thread (9) is provided on a housing circumference of the cartridge housing, said external thread (9) interacts with an internal thread (11) in the intermediate holder (2, 20).

7. The outlet fitting as claimed in claim 1, wherein the sanitary insert (6) comprises at least one of a jet regulator or a flow regulator.

8. A sanitary outlet fitting (1, 10) comprising a fitting body (3) having an enclosed body interior (4) which opens into a water outlet (5) having an outflow end, an intermediate holder (2, 20) having an inflow side and an outflow side, the intermediate holder being inserted from the outflow end in a direction generally normal to a longitudinal extension of the fitting body into the water outlet (5) in the fitting body such that the intermediate holder (2, 20) is located within the water outlet (5) of the fitting body (3), and a sanitary insert inserted from the outflow end into an end side of the intermediate holder (2, 20), said end side being open and being on the outflow side of the intermediate holder, the inflow side of intermediate holder (2, 20) has a connecting branch (8) which is connectable to a water hose, two webs or walls (12, 13) protrude on an end side of the intermediate holder (2) which is on the inflow side, said webs or said walls (12, 13) define a U-shaped space therebetween that acts in a form-fitting or frictional manner on a fin-shaped mating wall (14) or a fin-shaped mating web integrally formed with and extending from an inside of the fitting body (3), and a plurality of retaining projections (16) protrude toward each other on each of said two webs or walls (12, 13), said retaining projections being configured for bearing against said fin-shaped mating web or said fin-shaped mating wall (14).

9. The outlet fitting as claimed in claim 1, wherein retaining projections (16) protruding toward one another in each case into the insertion space are provided on the webs or walls (12, 13), which are assigned in pairs to one another, or the single mating web or single mating wall.

10. The outlet fitting as claimed in claim 1, wherein the intermediate holder (20) is expanded at least in a partial region of an intermediate-holder circumference thereof, by insertion of the sanitary insert (6), in such a manner that the intermediate holder (20) is subsequently held in a form-fitting or frictional manner in the water outlet (5).

11. The outlet fitting as claimed in claim 10, wherein the intermediate holder circumference of the intermediate holder (20) has at least one spring web (17) which, by insertion of the sanitary insert (6), is moveable or reboundable from a release position into a retaining position, and the spring web (17) engages behind a partial region of the fitting body (3) in said retaining position.

12. The outlet fitting as claimed in claim 11, wherein a free spring-web end (18) of the at least one spring web (17) is oriented in an insertion direction of the intermediate holder (20).

13. A sanitary outlet fitting (1, 10) comprising:

a fitting body (3) having an enclosed body interior (4) which opens into a water outlet (5) having an outflow end, an intermediate holder (2, 20) having an inflow side and an outflow side, the intermediate holder being inserted from the outflow end in a direction generally normal to a longitudinal extension of the fitting body into the water outlet (5) in the fitting body such that the intermediate holder (2, 20) is located within the water outlet (5) of the fitting body (3), a sanitary insert inserted from the outflow end into an end side of the intermediate holder (2, 20), said end side being open and being on the outflow side of the intermediate holder, the inflow side of intermediate holder (2, 20) has a connecting branch (8) which is connectable to a water hose, two webs or walls (12, 13) protrude on an end side of the intermediate holder (2) which is on the inflow side, said webs or said walls (12, 13) define a space therebetween that acts in a form-fitting or frictional manner on at least one mating wall (14) or at least one mating web integrally formed with and extending from an inside of the fitting body (3), the intermediate holder (20) is expanded at least in a partial region of an intermediate-holder circumference thereof, by insertion of the sanitary insert (6), such that the intermediate holder (20) is subsequently held in a form-fitting or frictional manner in the water outlet (5), the intermediate holder circumference of the intermediate holder (20) has at least one spring web (17) which, by insertion of the sanitary insert (6), is moveable or reboundable from a release position into a retaining position, and the spring web (17) engages behind a partial region of the fitting body (3) in said retaining position, with a free spring-web end (18) of the at least one spring web (17) being oriented in an insertion direction of the intermediate holder (20), and the spring web (17) includes a retaining cam or retaining projection (19) that protrudes at a free spring-web end (18) of the spring web (17), with which the spring web (17) engages behind an inner circumferential edge region of the fitting body (3), which in a circumferential edge region bounds the water outlet (5).

14. The outlet fitting as claimed in claim 1, wherein the sanitary insert is an insertable cartridge which has a cartridge housing that is inserted within the intermediate holder.

15. A sanitary outlet fitting (1, 10) comprising a fitting body (3) having an enclosed body interior (4) which opens into a water outlet (5) having an outflow end, an intermediate holder (2, 20) having an inflow side and an outflow side, the intermediate holder being inserted from the outflow end in a direction generally normal to a longitudinal extension of the fitting body into the water outlet (5) in the fitting body such that the intermediate holder (2, 20) is located within the water outlet (5) of the fitting body (3), and a sanitary insert inserted from the outflow end into an end side of the intermediate holder (2, 20), said end side being open and being on the outflow side of the intermediate holder, the inflow side of intermediate holder (2, 20) has a connecting branch (8) which is connectable to a water hose, two webs or walls (12, 13) protrude on an end side of the intermediate holder (2) which is on the inflow side, said webs or said walls (12, 13) define a space therebetween that acts in a form-fitting or frictional manner on at least one mating wall (14) or at least one mating web integrally formed with and extending from an inside of the fitting body (3), and the two webs or walls (12, 13) delimit a U-shaped insertion space (15) that opens toward the outflow end, and the at least one mating web or the at least one mating wall (14) is fixable via the space between said webs or said walls acting in a form-fitting or frictional manner by insertion in the direction generally normal to a longitudinal extension of the fitting body into said U-shaped insertion space (15) to connect the intermediate holder (20) to the fitting body (3).

* * * * *